US005172162A

United States Patent [19]

Taneda

[11] Patent Number: 5,172,162

[45] Date of Patent: Dec. 15, 1992

[54] APPARATUS FOR CONNECTING AN IMAGE RECORDING DEVICE TO A SHEET PROCESSOR

[75] Inventor: Kengo Taneda, Kanagawa, Japan

[73] Assignee: Fuji Xerox, Co., Ltd., Tokyo, Japan

[21] Appl. No.: 625,097

[22] Filed: Dec. 10, 1990

[51] Int. Cl.[5] ..... G03G 21/00

[52] U.S. Cl. ..... 355/202; 270/53; 271/290; 271/301; 355/207; 355/321; 355/323; 355/324

[58] Field of Search ..... 355/308, 309, 319, 321, 355/323, 324, 202, 207; 271/3, 4, 6, 7, 65, 289, 290, 301; 270/37, 53

[56] References Cited

U.S. PATENT DOCUMENTS

| | | | |
|---|---|---|---|
| 3,778,051 | 12/1973 | Allen et al. | 271/262 |
| 3,936,180 | 2/1976 | Willard et al. | 355/202 |
| 4,231,567 | 11/1980 | Ziehm | 271/259 |
| 4,248,525 | 2/1981 | Sterret | 271/289 X |
| 4,530,593 | 7/1985 | Kasuya et al. | 355/323 |
| 4,534,643 | 8/1985 | Watanabe | 271/290 X |
| 4,585,333 | 4/1986 | Yamagishi | 355/202 |
| 4,750,020 | 6/1988 | Ishizu et al. | 355/205 |
| 4,782,363 | 11/1988 | Britt et al. | 355/321 |
| 4,801,981 | 1/1989 | Chikano et al. | 355/308 |
| 4,949,134 | 8/1990 | Iwaki et al. | 355/319 X |
| 4,961,092 | 10/1990 | Rabb et al. | 355/323 |

FOREIGN PATENT DOCUMENTS

| | | | |
|---|---|---|---|
| 63-236693 | 3/1988 | Japan . | |
| 63-173695 | 7/1988 | Japan . | |
| 0298256 | 12/1988 | Japan | 355/324 |
| 64-29344 | 2/1989 | Japan . | |
| 64-43042 | 2/1989 | Japan . | |
| 1-127554 | 5/1989 | Japan . | |
| 1-176752 | 7/1989 | Japan . | |

*Primary Examiner*—A. T. Grimley
*Assistant Examiner*—J. E. Barlow, Jr.
*Attorney, Agent, or Firm*—Finnegan, Henderson, Farabow, Garrett and Dunner

[57] ABSTRACT

An apparatus for connecting an image recording device having a sheet outlet opening with an external sheet processor having an inlet opening. The apparatus includes an intermediate transfer unit interposed between the image recording device and the external sheet processor, a sheet transfer path disposed in the transfer unit and extending between and connecting the outlet opening of the image recording device with the inlet opening of the external sheet processor, a purge tray disposed in the transfer unit, and a gating unit disposed in the transfer unit for diverting a sheet from the sheet path to the purge tray.

12 Claims, 3 Drawing Sheets

APPARATUS FOR CONNECTING AN IMAGE RECORDING DEVICE TO A SHEET PROCESSOR

BACKGROUND OF THE INVENTION

1. Field of the Invention

This invention relates to an apparatus for connecting an image recording device such as a printer or an electronic copying machine to sheet processors. More particularly, the invention is directed to a device capable of connecting an otherwise incompatible sheet handling type processor with an image recording apparatus through an intermediate transfer unit.

2. Discussion of the Related Art

Sheets recorded by an image recording apparatus such as a printer or an electronic copying machine are generally transferred to a processor, such as a sorter. A binder or other type of finishes, may also be connected to the image recording apparatus. For example, in Japanese Patent Unexamined Publication No. 173695/1988, a binder is directly connected to an electronic copying machine and the recorded sheets produced by the electronic copying machine are bound into books and discharged to a discharge tray.

In the related art, when a sorter, a binder, or other finisher is incompatible with the image recording apparatus in terms of sheet transfer direction, such incompatibility may be eliminated by interposing a sheet transfer direction changing mechanism between the two incompatible components. This allows the outgoing recorded sheet from the image recording apparatus to be received by the downstream processor, e.g., 90° rotated.

In the example disclosed in Japanese Utility Model Unexamined Publication No. 29344/1989, the sheet transfer direction changing unit is disposed between the electronic copying machine and a paper folding unit so that large size sheets can be oriented to be received properly by the sheet folding unit.

The sheet transfer direction changing unit may also be disposed between an electronic copying machine and a sorter. In order to change the sheet travel direction by 90°, a rotary disk-like member may be used, as disclosed in Japanese Patent Unexamined Publication No. 176752/1989, or two rollers may be provided, each being driven at different speeds, as disclosed in Japanese Patent Unexamined Publication No. 43042/1989.

Thus, in a processing system with an incompatible processor and image recording apparatus, a solution to the incompatibility is to provide means for changing the sheet transfer direction to facilitate the operation at the incompatible processor.

In the related art image recording apparatus, a processor to be connected to a device such as an online finisher is, in most cases, of the same origin as that of the image recording apparatus or of the same or compatible design both mechanically and electronically, and their controllers are also designed so that they can be used in combination.

It may be occasionally required that a sophisticated processor such as a saddle stitcher, a stapler, or a binder be connected to a system consisting of the image processing apparatus and the related art binder or sorter. This further complicates system connection and control.

In such a case, the processors to be connected downstream to the image recording apparatus may be incompatible with each other because they are made by different manufacturers. Nevertheless, it is required that such optional processor be able to properly process the recorded sheets while connected to a main system with which it is basically incompatible.

However, when an incompatible processor is connected downstream of the main system, the controller of the image recording apparatus may not be able to manage the controllers of its processors because their controlling procedures may, in many cases, be different from one another.

For example, if a jam occurs in the image recording apparatus or the online finisher, and the jam is eliminated but has produced some defective pages, the final processor may bind the defective recorded sheets containing into books. With the connection of the final processor to the main system in an existing manner, the production of defective books cannot be eliminated or prevented.

If a purge tray is provided to divert defective recorded sheets from the final processor, the above problem may be overcome. However, the provision of a purge tray may require extensive modification and investment.

Therefore, in the event of such a failure in the main system, the defective recorded sheets received by the final processor must be destroyed and the same sheets must be produced again. This results in a waste of sheets.

In addition to functional incompatibility among controllers, incompatibility in mechanical design, i.e., height, must also be taken into consideration when connecting incompatible components, e.g., the online finisher and the final processor.

When connecting the online finisher to an incompatible processor downstream of the image recording apparatus, it is the final processor that is adjusted to align the height of the three components. However, it is cumbersome to make such an adjustment. Further, the related art online finisher has a sheet transfer path to be connected to the upstream component, but not, to accommodate a downstream processor. Thus, to connect a processor downstream to the related art online finisher, it is required that the online finisher be largely retrofitted, which is expensive.

SUMMARY OF THE INVENTION

In view of the above circumstances, an object of the present invention is to provide a device for easily connecting an image recording apparatus to processors that would otherwise be incompatible with the image recording apparatus.

Another object of the present invention is to provide a device for connecting an image recording apparatus to processors so that recorded sheets which should not be discharged to the other processor can be diverted in the event of a jam at any upstream component.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus for connecting an image recording device to processors comprises an intermediate transfer unit interposed between the image recording device and the external sheet processor, a sheet transfer path disposed in the transfer unit, the path extending between and connecting the outlet opening of the image recording device with the inlet opening of the external sheet processor, a purge tray disposed in the transfer unit, and gating means disposed in the transfer unit for diverting a sheet from the sheet path to the purge tray.

The intermediate transfer unit may be provided not only with a sheet transfer direction changing unit within its sheet transfer path but also with a frequently used internal processor so that recorded sheets can be diverted to the internal processor from the sheet transfer path connecting the image recording apparatus and compatible processor through the gate units.

Controllers provided respectively at the image recording apparatus and the intermediate transfer unit may be connected directly so that signals from the image recording apparatus can be applied to control the operation of various mechanisms of the intermediate transfer unit. A controller provided at the incompatible processor connected to the image recording apparatus through the intermediate transfer unit may transmit and receive a signal to and from the controller of the intermediate transfer unit.

As described above, the intermediate transfer unit interposed between the image recording apparatus and the incompatible processor allows for smooth transfer of sheets between the image recording apparatus and the incompatible processor to overcome the problem of incompatibility in constructing a system using a combination or various components.

Since the intermediate transfer unit can communicate with each of the three components, the image recording apparatus, the incompatible processor, and the compatible processor, a failure at any upstream component can be handled by the compatible processor. This dispenses with direct transmission of signals between the image recording apparatus and the incompatible processor to increase the various types of processors that may be connected to the image recording apparatus.

The inclusion of a purge tray at the intermediate transfer unit eliminates the need for a purge ray to be provided at the incompatible processor. This not only simplifies jam processing but also reduces requirements on the part of the manufacturer of the incompatible processor.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention.

FIG. 3(*b*) is a diagram illustrating a state in accordance with the present invention in which a sheet is transferred to a purge tray;

FIG. 3(*c*) is a perspective view depicting the structure of a gate unit in accordance with the present invention.

DESCRIPTION OF THE PREFERRED EMBODIMENTS

The configuration of a device connecting an image recording apparatus to a processor according to the present invention will be described with reference to the examples shown in the accompanying drawings.

Figure 1:
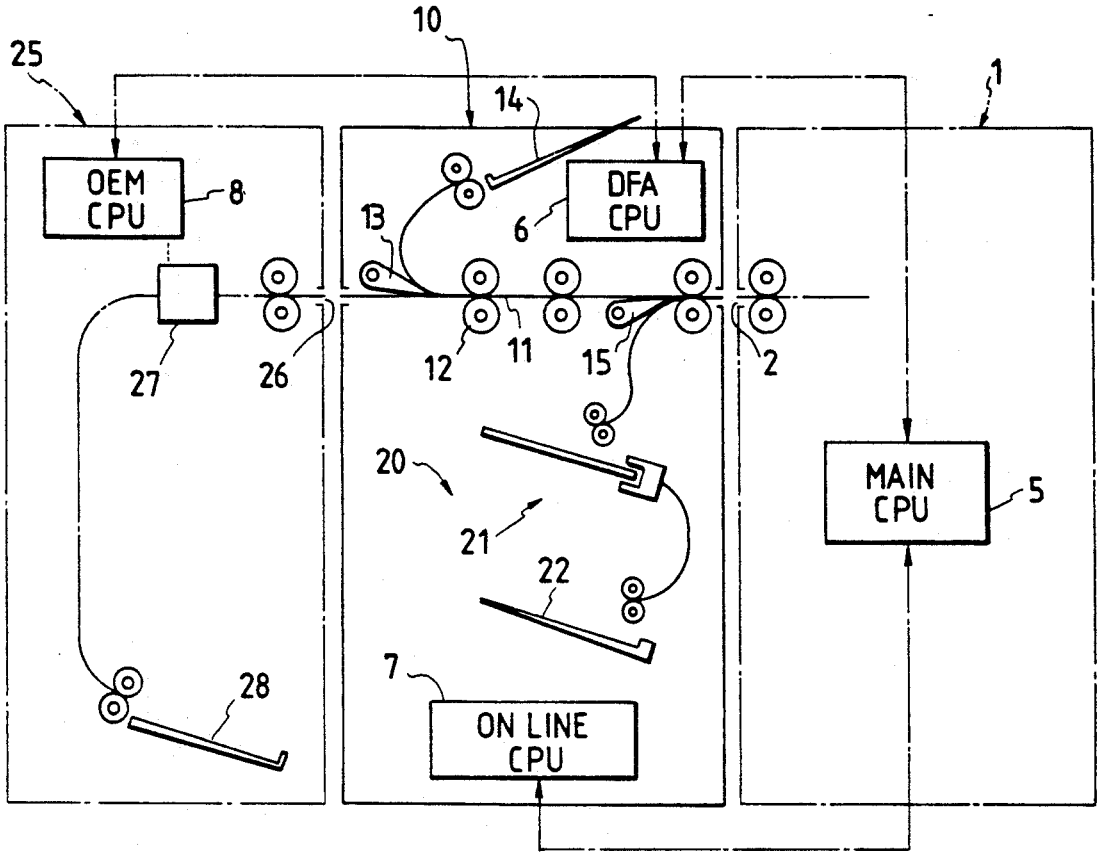
FIG. 1 is a diagram showing the configuration of an apparatus for connecting an image recording device to a sheet processor.

FIG. 1 shows an embodiment in which an internal sheet processor such as online finisher 20 including a stapler 21 is connected to an image recording apparatus 1 such as a laser printer or any type of recording apparatus. In FIG. 1, an external sheet processor, such as finisher 25 (hereinafter referred to as "OEM finisher 25," the term "OEM" standing for "original equipment manufacturer"), that includes a saddle stitcher 27, is incompatible with the image recording apparatus 1 and the online finisher 20 as originally manufactured.

To connect OEM finisher 25 to online finisher 20, there is provided sheet transfer path 11 for connecting discharging outlet 2 of image recording apparatus 1 to inlet 26 of OEM finisher 25 so that a recording sheet can be transferred to each of the finishers 20 and 25 through sheet transfer path 11.

A sheet transfer unit including sheet transfer path 11 forms DFA 10. Sheet transfer path 11 of DFA 10 is provided with gate units 13 and 15 so that a recorded sheet can be diverted to online finisher 20, purge tray 14, and OEM finisher 25.

In the above embodiment, DFA 10 is provided with transfer roller units 12 along sheet transfer path 11 so that the recorded sheet can be transferred by driving the roller units 12.

Further, purge tray 14 is disposed at a path diverting from sheet transfer path 11 through gate unit 13 so that purge tray 14 can receive a recorded sheet not destined for OEM finisher 25 for proper processing.

The recorded sheet is discharged to purge tray 14 to prevent a set of related sheets from being further transferred to OEM processor 25 when jammed at sheet transfer path 11. The operation of discharging the sheet to purge tray 14 will be described in detail later.

Stapler 21, which is the most frequently used processor connected to an image recording apparatus 1, is disposed at a path diverting from sheet transfer path 11 through gate unit 15. Upon deposition of a predetermined number of recorded sheets, stapler 21 staples the sheets together an collects the stapled sheets in tray 22.

As shown in the embodiment of FIG. 1, OEM finisher 25, which is disposed downstream of online finisher 20, is provided with saddle stitcher 27 for binding recorded sheets into books by depositing a predetermined number of sheets and binding the folded portion at the middle of each sheet using a stapler on the like.

The books prepared by saddle stitcher 27 are accommodated in discharge tray 28 as stapled or as folded in half at the stapled portion.

To control the above system consisting of a plurality of components in combination, there is provided main CPU (central processing unit) 5, DFA CPU 6, online finisher CPU 7, and OEM finisher CPU 8.

Main CPU 5 controls the operation of recording a sheet at image recording apparatus 1, while DFA CPU 6 controls the sheet transfer unit at DFA 10, the operation of diverting the recorded sheet by driving the gate units 13 and 15, and the operation of discharging the recorded sheet to purge tray 14 in accordance with signals applied from image recording apparatus 1.

Online finisher CPU 7 controls the operation of forming a book by online finisher 20, while OEM finisher CPU 8 controls the operation of the sheet transfer unit, saddle stitcher 27, and other related components at OEM finisher 25.

In the above controllers, main CPU 5 of image recording apparatus 1 is arranged so that the data of a recorded sheet to be discharged from image recording apparatus 1 and the data for processing the recorded sheet can be transmitted among main CPU 5, DFA CPU 6, and online finisher CPU 7.

In accordance with the present invention, a signal between OEM finisher CPU 8 and main CPU 5 can be transmitted directly in the same manner as between main CPU 5 and DFA CPU 6/online finisher CPU 7 as long as it is designed to allow a signal circuit to be provided between both controllers.

However, if OEM finisher 25 is incompatible with image recording apparatus 1 because the control systems of the two components are different, a large-scale modification would be required to allow direct communication therebetween. In such a case, it is not necessary to provide signal transmission system between main CPU 5 and OEM finisher CPU 8.

That is, in the present invention it is sufficient to provide a system that transmits between DFA CPU 6 and OEM finisher CPU 8 simple data such as an instruction that supply sheets be transferred instead of providing a direct communication line between OEM finisher CPU 8 and main CPU 5. The operation of each mechanism in OEM finisher 25 may be performed in accordance with a program internally set in OEM finisher CPU 8.

OEM finisher CPU 8 can control each mechanism within itself in accordance with sheet data to be received from DFA CPU 6, in addition to operating saddle stitcher 27 to bind the recorded sheets into finished products such as books.

According to the present invention, OEM finisher 25 is separately purchasable by a user and would normally be incompatible with image recording apparatus 1 because it is produced by a manufacturer different from that of its image recording apparatus 1.

Figure 2A:
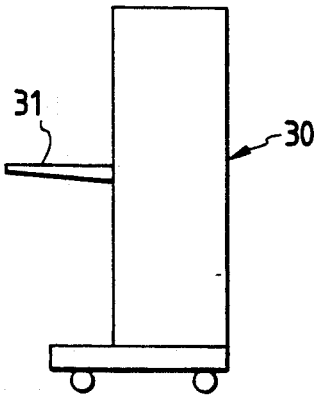
FIGS. 2(*a*) and 2(*b*) are diagrams illustrating a processor to be used as an incompatible finisher in the present invention.
Figure 2B:
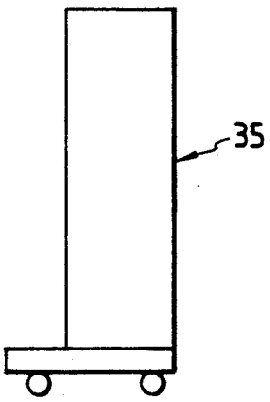

OEM finisher 25 may be provided not only with saddle stitcher 27 as shown in FIG. 1 but also with a large-capacity tray 30 as shown in FIG. 2(*a*). Large-capacity tray 30 may be arranged so that it can accommodate a large volume of recorded sheets from a vertically movably disposed discharge tray 31 such as one disclosed in Japanese Patent Unexamined Publication No. 127554/1989.

OEM finisher 25 may also include a binder 35 as shown in FIG. 2(*b*). Binder 35 may be, for example, a unit disclosed in Japanese Patent Unexamined Publication No. 236693/1988.

The related art binder binds a predetermined number of received sheets into a book by taping the spine using a binding tape. In the present invention a binder of any type may be used.

While, the above-mentioned OEM finisher 25 is incompatible with image recording apparatus 1 from a hardware standpoint, it usually has sophisticated mechanisms and exhibits higher performance than a similar type finisher that is compatible with image recording apparatus 1.

One reason why OEM finisher 25 may not be compatible with the system of image recording apparatus 1 and online finisher 20 is that it usually has its own system of control and signal transmission. Therefore, to control such OEM finisher 25 in cooperation with the controllers of image recording apparatus 1 and DFA 10, OEM finisher 25 must be modified by expending significant labor and cost.

Thus, in the present invention, OEM finisher 25 is provided with OEM finisher CPU 8 so that OEM finisher 25 can internally be controlled autonomously and externally be controlled in such a limited way as to transmit a sheet transfer signal and start and end signals to either image recording apparatus 1 or DFA 10.

As described earlier, the communication of OEM finisher 25 with image recording apparatus 1 or DFA 10 can be implemented more easily by the insertion of an intermediate transmitting means rather than connecting them directly.

DFA 10 shown in FIG. 1 transfers the recorded sheet to OEM finisher 25 by transfer roller units 12 disposed along sheet transfer path 11. The two gate units 13 and 15, disposed along sheet transfer path 11, divert the destination of the recorded sheet to purge tray 14 or online finisher 20, respectively.

Gate units 13 and 15 disposed at DFA 10 are controlled in a sheet transfer mode. For example, as shown in FIG. 3(*a*), if neither gate unit 13 or 15 blocks sheet transfer path 11, the recorded sheet discharged from image recording apparatus 1 is destined to OEM finisher 25 through sheet transfer path 11.

Figure 3A:
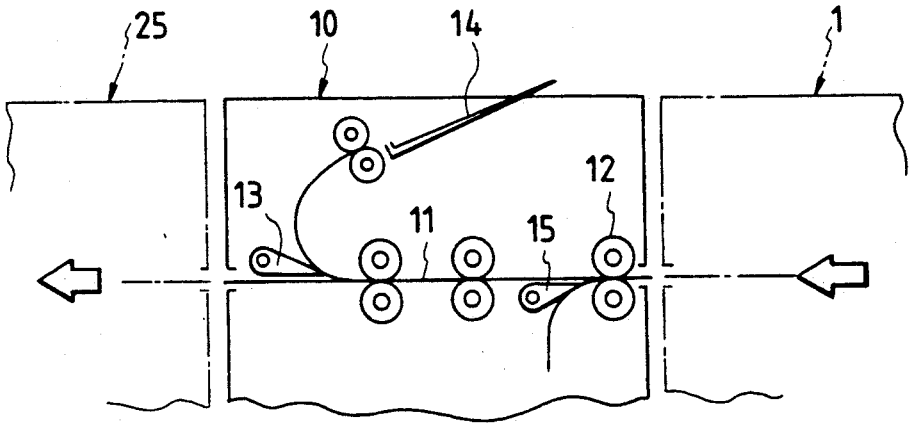
FIG. 3(*a*) is a diagram illustrating a case in which an intermediate transfer unit according to the present invention transfers a sheet toward the incompatible finisher.
Figure 3B:
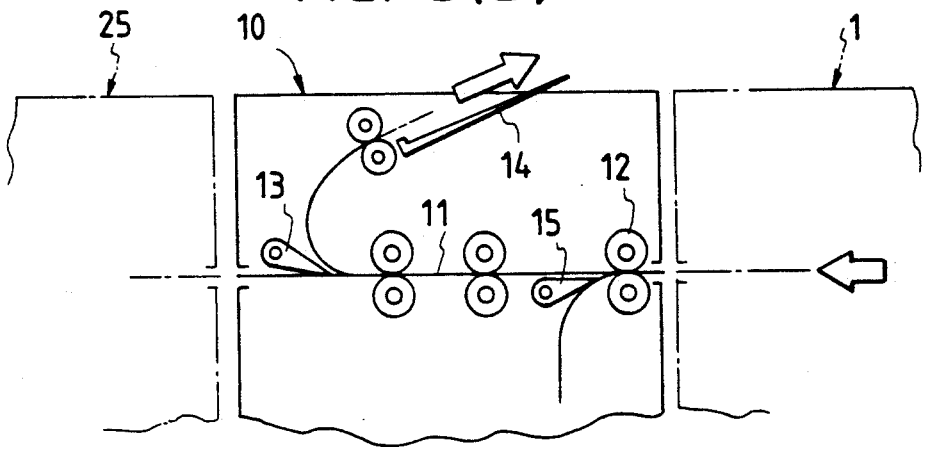
Figure 3C:
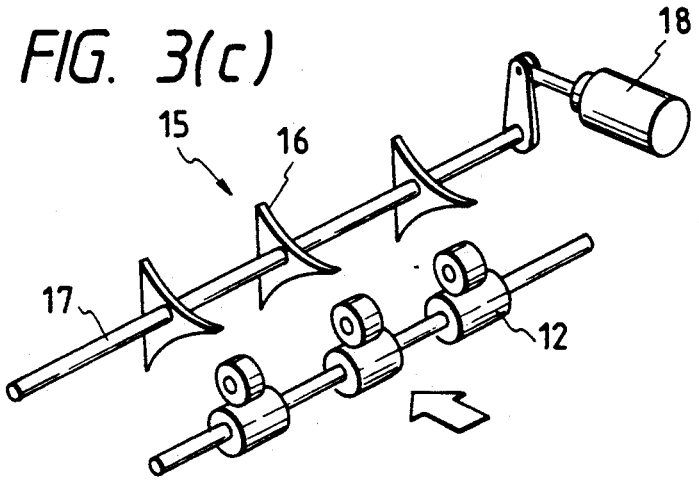

As shown in FIG. 3(*b*), if gate unit 13 is moved to a position blocking sheet transfer path 11, the recorded sheet will be discharged to purge tray 14. On the other hand, if gate unit 15 is rotated to block path 11, the recorded sheet will be transferred to online finisher 20.

Gate units 13 and 15 disposed in sheet transfer path 11 may be similar to those disposed at the sheet transfer path of any related art electronic copying machine. For example, a gate unit of such a structure as shown in FIG. 3(*c*) may be used.

In gate unit 15 shown in FIG. 3(*c*), drive shaft 17 rotated by solenoid 18 is provided with a number of gate members 16, which members are projected so that transfer rollers 12 can block sheet transfer path 11 to divert the incoming recorded sheet.

Purge tray 14 disposed at DFA 10 serves to receive a recorded sheet when, for example, a jam occurs along the sheet transfer path of image recording apparatus 1. That is, upon occurrence of a jam, a jam signal is issued and it causes a jam clear signal to be applied to the display section of image recording apparatus 1 so that the operator can perform jam processing in the sheet transfer path.

When the operation of the image processing apparatus 1 is resumed upon completion of jam processing, main CPU 5 of image recording apparatus 1 sends an instruction to DFA CPU 6 to discharge unqualified recorded sheets to purge tray 14. By the term "unqualified sheets" it is intended to mean those sheets held in the sheet transfer path of image recording apparatus 1 during the jam processing and liable to form books with missing pages if sent to the processing unit unchecked.

Upon receipt of the instruction to discharge the unqualified sheets to purge tray 14 from main CPU 5 to DFA CPU 6, DFA CPU 6 drives gate unit 13, selects a sheet transfer mode to purge tray 14, and discharges a predetermined number of sheets to purge tray 14.

Upon completion of unqualified sheet discharge, an end signal is sent from DFA CPU 6 to main CPU 5, and gate unit 13 of DFA 10 is returned to its original position to make image recording apparatus 1 ready to transfer a recorded sheet to OEM finisher 25 through sheet transfer path 11.

If recorded sheets are disqualified due to a jam or a similar failure occurring in OEM finisher 25, DFA 10 of the present invention may make up for the absence of means for transmitting a signal from OEM finisher 25 to image recording apparatus 1 by causing, for example, DFA CPU 6 to relay to main CPU 5 a stop signal received from OEM finisher 25. In this way, image recording apparatus 1 can be suspended, and gate unit 13 may be operated so that the successive "unqualified" recorded sheets in sheet transfer path 11 can be discharged into purge tray 14. The disqualified recorded sheet received by OEM finisher 25 must be removed from its discharge tray 31 and destroyed.

In the embodiment of the present invention shown in FIG. 1, a frequently used online finisher is connected to DFA 10. DFA 10 of the present invention may, as shown in FIG. 4, be formed of only the intermediate transfer unit without online finisher 20.

Figure 4:
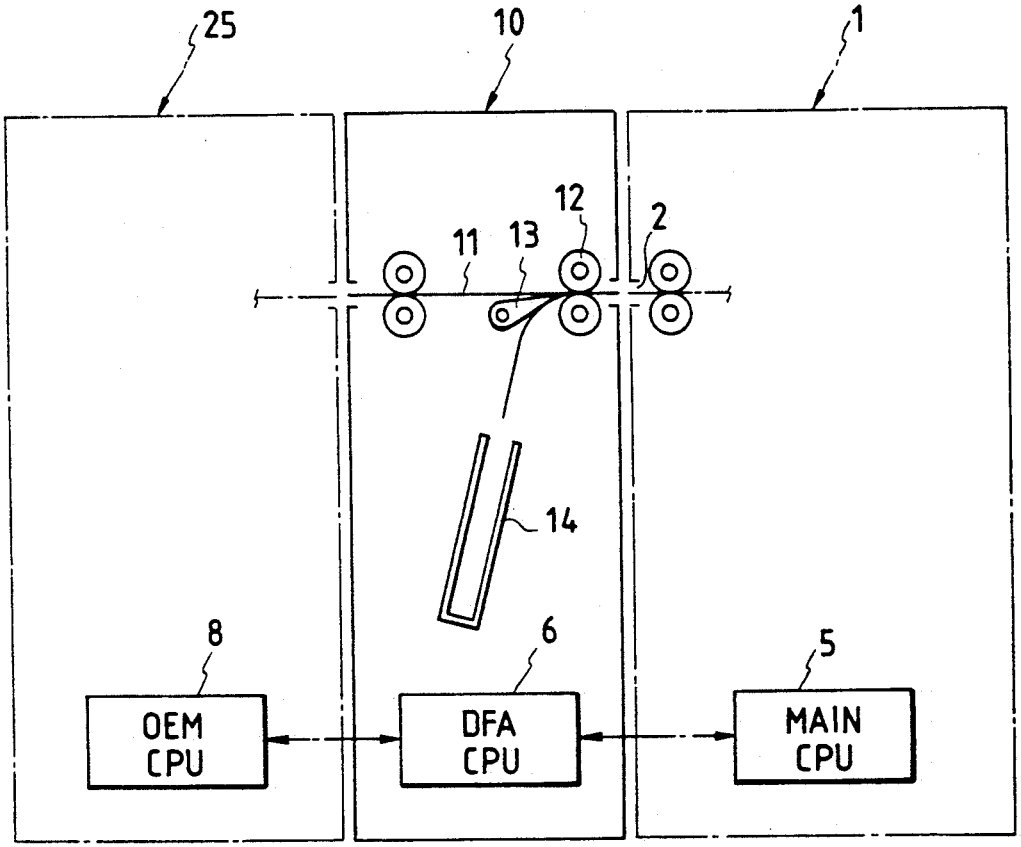
FIG. 4 is a diagram illustrating another configuration of the intermediate transfer unit according to the present invention.

DFA 10 as shown in FIG. 4 includes only one gate unit 13 to divert a recorded sheet from sheet transfer path 11 to purge tray 14. As described before, if any defective sheet is produced due to a jam at image recording apparatus 1 or DFA 10, a group of sheets including the defective sheet are discharged to purge tray 14 so that only the normally recorded sheets can be received by OEM finisher 25.

In the embodiment shown in FIG. 1, main CPU 5 and DFA CPU 6 are directly connected to cause main CPU 5 to control DFA 10, while DFA CPU 6 and OEM finisher CUP 8 are connected to transmit a minimum amount of control signals therebetween.

Therefore, in the embodiment shown in FIG. 4, it is also possible to operate the related components in proper cooperation, similar to the embodiment shown in FIG. 1, to produce recorded sheets and bind them into books.

The DFA 10 according to the present invention is arranged so that differences in height between the discharge outlet of image recording apparatus 1 and the feed inlet of OEM finisher 25 can be accommodated by inclining sheet transfer path 11. This allows a recorded sheet to be transferred between image recording apparatus 1 and OEM finisher 25 through the inclined path. Inclined sheet transfer path 11 can be provided with the gate unit, the stapler, the purge tray, and other components.

An ordinary processing unit to be connected to machines such as image recording apparatus 1 transfers a recorded sheet in accordance with the transfer system of image recording apparatus 1. For example, if image recording apparatus 1 handles a horizontally placed A4 size sheet, the processing unit receives the sheet as fed thereto and subjects the sheet to a process such as binding.

However, when connecting a processing unit to an image recording apparatus that is incompatible therewith, the situation may arise wherein an image recording apparatus with a vertical transfer system must be connected to a processing unit with a horizontal transfer system.

In order to allow such incompatible systems to be connected so that they can function, it is necessary to provide a transfer direction changing mechanism in sheet transfer path 11 at DFA 10. The DFA 10 according to the present invention may employ any type of mechanism including the rotary disk-like member or the two rollers respectively driven at different speeds as described above.

The sheet transfer direction changing mechanism to be disposed at sheet transfer path 11 of DFA 10 may also be of any type including an attached unit of the related art electronic copying machine.

The above sheet transfer direction changing mechanism causes a vertically transferred sheet to travel horizontally. This allows both incompatible components to be connected easily without modifying OEM finisher 25 so that the sheet transfer direction of OEM finisher 25 will be compatible with that of the image recording apparatus.

As described previously, when providing the sheet transfer path at the DFA 10 with a sheet transfer direction changing mechanism, the gate unit to divert a recorded sheet to the purge tray must be disposed downstream of the sheet transfer direction changing mechanism so that any failure to reorient the recorded sheet in the sheet transfer path can be duly processed with ease.

The device for connecting the image recording apparatus to the processors with the above configuration allows recorded sheets to be smoothly transferred from the image recording apparatus to the processor, i.e., the OEM finisher 25 of any type.

In the above embodiments, since the intermediate transfer unit can communicate with each of the three components, the image recording apparatus, the incompatible processor, and the compatible processor, a failure at any upstream component can be handled by the compatible processor. This dispenses with the need to directly transmit signals between the image recording apparatus and the incompatible processor, thereby increasing the number of different types of processors that can be connected to the image recording apparatus.

Further, since a purge tray 14 is provided as part of the online finisher 20, it no longer is necessary to have an additional purge tray at the OEM finisher 25, thereby not only reducing the jam processing procedure but also reducing the amount of special requirements to be imposed on the manufacturer of the OEM finisher 25.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for connecting an image recording device having a sheet outlet opening with an external sheet processor having a sheet inlet opening, wherein the image recording device includes image processing means for processing a plurality of images and for sending sheet data, and wherein the external sheet processor includes controller means for controlling the processing of a plurality of sheets and for receiving sheet data from said image processing means when the image recording device is compatible with the external sheet processor, the apparatus comprising:

an intermediate transfer unit interposed between the image recording device and the external sheet processor;

a sheet transfer path disposed in said intermediate transfer unit, said path extending between and connecting the sheet outlet opening of the image recording device and the sheet inlet opening of the external sheet processor;

a purge tray disposed in said intermediate transfer unit;

grating means, disposed in said intermediate transfer unit, for selectively diverting a sheet from said sheet path to said purge tray; and processing means, in said intermediate transfer unit, for sending sheet data to said controller means of said external sheet processor when the image recording device is incompatible with the external sheet processor.

2. The apparatus as set forth in claim 1, further including a sheet transfer direction change unit disposed in said intermediate transfer unit.

3. The apparatus as set forth in claim 1, further including an internal sheet processor disposed within said intermediate transfer unit, and wherein said gating means is also for diverting a sheet from said sheet transfer path to said internal sheet processor.

4. An apparatus as set forth in claim 3, further including a controller disposed in said intermediate transfer unit, said controller for controlling said internal sheet processor of said intermediate transfer unit in response to a signal received from the image processing means of said image recording device.

5. An apparatus as set forth in claim 4, wherein said processing means of said intermediate transfer unit is connected to the controller means of said external sheet processor for communication therewith when the image recording device is incompatible with the external sheet processor.

6. An apparatus as set forth in claim 2, further including an internal sheet processor disposed within said intermediate transfer unit, and wherein said gating means is also for diverting a sheet from said transfer path to said internal sheet processor.

7. An apparatus as set forth in claim 6, further including a controller disposed in said intermediate transfer unit, said controller for controlling said internal sheet processor of said intermediate transfer unit in response to a signal received form the image processing means of said image recording device.

8. An apparatus as set forth in claim 7, wherein said processing means of said intermediate transfer unit is connected to the controller means of said external sheet processor for communication therewith when the image recording device is incompatible with the external sheet processor.

9. An apparatus as set forth in claim 3, wherein said gating means includes a first gate unit for diverting sheets from said sheet path to said purge tray and a second gate unit for diverting sheets from said sheet path to said internal sheet processor.

10. An apparatus as set forth in claim 6, wherein said gating means includes a first gate unit for diverting sheets from said sheet path to said purge tray and a second gate unit for diverting sheets from said sheet path to said internal sheet processor.

11. An apparatus as set forth in claim 3, wherein said internal processor includes a stapling device.

12. An apparatus as set forth in claim 4, wherein said processing means is responsive to sheet data from both said image processing means of said image recording device and said controller means of said external sheet processor.

* * * * *

UNITED STATES PATENT AND TRADEMARK OFFICE

CERTIFICATE OF CORRECTION

PATENT NO. : 5,172,162

DATED : December 15, 1992

INVENTOR(S) : Kengo Taneda

It is certified that error appears in the above-identified patent and that said Letters Patent is hereby corrected as shown below:

On the title page, item [73] Assignee, change "Fuji Xerox, Co., Ltd.," to --Fuji Xerox Co. Ltd.--.

Claim 1, column 9, line 11, change "grating" to --gating--.

Claim 7, column 10, line 12, change "form" to --from--.

Claim 6, column 10, line 6, after "said" insert --sheet--.

Claim 9, column 10, line 22, before "path" insert --transfer--.

Claim 9, column 10, line 24, before "path" insert --transfer--.

Claim 10, column 10, line 27, before "path" insert --transfer--.

UNITED STATES PATENT AND TRADEMARK OFFICE

CERTIFICATE OF CORRECTION

PATENT NO. : 5,172,162

DATED : December 15, 1992

INVENTOR(S) : Kengo Taneda

It is certified that error appears in the above-indentified patent and that said Letters Patent is hereby corrected as shown below:

Claim 10, column 10, line 29, before "path" insert --transfer--.

Signed and Sealed this

Twenty-first Day of December, 1993

*Attest:*

Bruce Lehman

BRUCE LEHMAN

*Attesting Officer*

*Commissioner of Patents and Trademarks*